United States Patent [19]

Henry et al.

[11] Patent Number: 4,586,275

[45] Date of Patent: May 6, 1986

[54] ICE SURFACING APPARATUS

[76] Inventors: Emile J. Henry, 81 3691 Albion Rd. South, Gloucester, Ontario, Canada, K1T 1P2; Donald J. Belanger, 50 Mark Ave., Ottawa, Canada, K1L 6A6

[21] Appl. No.: 732,943

[22] Filed: May 13, 1985

[30] Foreign Application Priority Data

Jul. 12, 1984 [CA] Canada ..... 458,731

[51] Int. Cl.[4] ..... E01H 5/10

[52] U.S. Cl. ..... 37/227; 126/401; 404/95

[58] Field of Search ..... 37/227, 228, 219, 196–197; 172/23, 26.5; 404/79, 95; 126/401, 343.5 R, 343.5 A

[56] References Cited

U.S. PATENT DOCUMENTS

| | | | |
|---|---|---|---|
| 337,128 | 3/1886 | Calantarients | 404/95 |
| 1,203,531 | 10/1916 | Givens | 37/227 X |
| 1,332,609 | 3/1920 | Crawford | 172/26.5 |
| 3,692,119 | 9/1972 | Tucker | 172/23 |

FOREIGN PATENT DOCUMENTS

| | | | |
|---|---|---|---|
| 692617 | 8/1964 | Canada | 37/227 |
| 1113427 | 12/1955 | France | 172/26.5 |
| 200977 | 1/1966 | Sweden | 37/227 |
| 609400 | 2/1979 | Switzerland | 37/227 |

*Primary Examiner*—E. H. Eickholt

*Attorney, Agent, or Firm*—Balogh, Osann, Kramer, Dvorak, Genova & Traub

[57] ABSTRACT

Apparatus for the re-surfacing of an ice surface particularly the surface of a curling rink. An ice melting machine having a plurality of burners is drawn at a slow and uniform rate of speed along a curling rink by a winch arrangement which is adapted for removable securement adjacent one end of the rink. A cable extends from the melting machine to the winch, and means are provided for stopping the winding of the cable when a predetermined length of cable has been wound on the winch. The winch includes a drum which has a diameter and a speed of rotation such that the machine is drawn along at a speed in the range of between about 3 to 4 feet per minute. This apparatus ensures uniform melting surface ice and frees an attendant for other duties.

21 Claims, 4 Drawing Figures

ICE SURFACING APPARATUS

The present invention relates to apparatus for economically and uniformly re-surfacing an ice surface particularly the ice surface of a curling rink.

It is known that through normal usage, the ice in a curling rink must be re-surfaced approximately every seven days to provide the necessary smoothness and evenness for precise travel of a curling stone sliding thereover. This re-surfacing is conventionally accomplished by slowly drawing an ice melting machine along the surface of the ice to melt the ice to a small depth (in the order of approximately ¼ inch) to smooth the ice and to permit dirt which has become trapped in the ice to surface for removal.

The melting machine usually is in the form of a wheeled structure carrying a plurality of burners which extend the width of the curling ice sheet and which direct heat downwardly toward the ice surface. The machine is usually fueled by propane or other liquified petroleum gas or the like.

As the depth of melting is dependent upon the amount of heat directly applied, it is important that the melting machine be slowly but at constant uniform speed be moved along the ice sheet to obtain uniform melting and smoothness as irregular travel movement will result in non-uniform melting, and unsatisfactory surfacing.

PRIOR PROCEDURE

This melting machine is conventionally drawn along the ice surface by an attendant and as the rate of movement must be relatively slow to enable the melting of the ice to a desired depth, it requires on the average about 40 minutes to re-surface one sheet of ice. This is a long time to attempt to draw the melting machine at relatively constant slow speed and any inattention by the operator will result in irregular movement with resultant uneven melting. Moreover, this procedure requires the constant presence of an operator and considering the many sheets of ice in a curling establishment the cost of attendant care in re-surfacing itself becomes a significant factor in the overall cost of operation. Additionally, and while one or more attendants busy themselves with the lengthy time necessary for re-surfacing, they are not able to devote themselves to many of their other duties around the establishment.

To free operators for other duties, various attempts have been made to self-power the melting machines, but these self-propelled arrangements quite apart from being expensive have not proved to be satisfactory with respect to dependability and uniformity of movement along the ice surface.

THE PRESENT INVENTION

The present invention is directed to apparatus to draw at constant uniform speed a wheeled ice melting machine along the length of a sheet of curling ice to provide uniform-melting and re-surfacing and which does not require operator attendance during complete movement through the re-surfacing operation.

These advantages are obtained through the use of a constant low speed winch arrangement which is adapted for removable securement at one end of a curling rink and which in operation pulls by means of a cable an ice-melting machine at a dependable constant and uniform rate of movement.

The winch arrangement is electrically powered and in preferred construction a valve governing the flow of fuel to the burners in the ice-melting machine is controlled by the tension in the cable drawing the machine so that any interruption in the operation of the winch (such as interrruption of electrical power) will result in closing of the valve to stop fuel flow to the burners. Additionally and also in preferred construction, the winch is provided with means to automatically stop the winching operation once a desired length of cable has been wound on the winch drum, and this as a result of the relaxation of tension in the cable will stop burner operation.

The invention also contemplates the provision of audio and/or visual alarms on either or both of the winch and melting machine to warn of any malfunction or to indicate the completion of a re-surfacing operation.

BRIEF DESCRIPTION OF DRAWINGS

The inventive concept will now be more fully described with reference to the accompanying drawings wherein like reference numerals refer to like parts and wherein.

DETAILED DESCRIPTION OF DRAWINGS

Figures 1, 2:
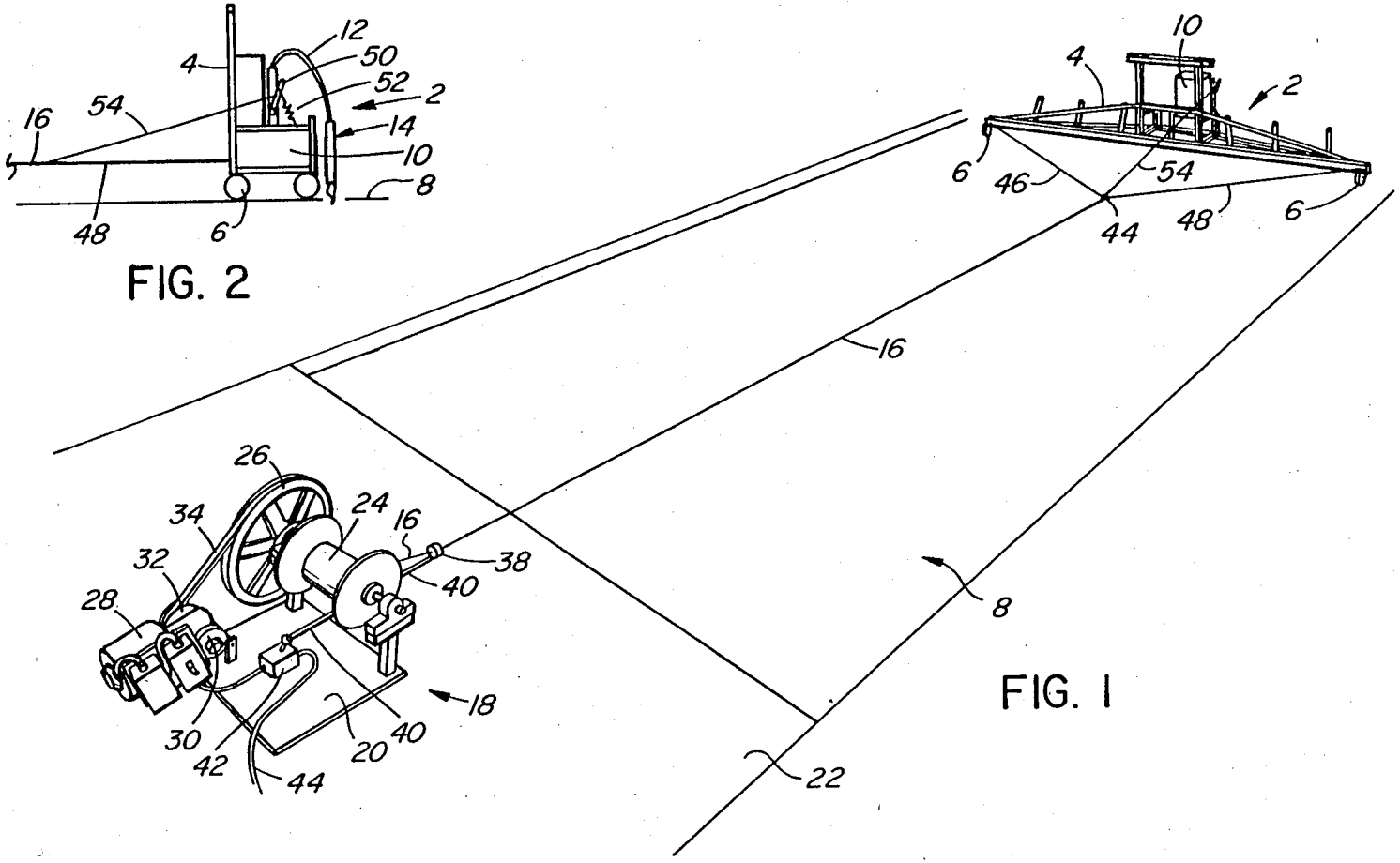
FIG. 1 illustrates in schematic perspective view a winch arrangement according to the present invention in combination with an ice-melting machine.
FIG. 2 illustrates in schematic side view one embodiment of the ice-melting machine as illustrated in FIG. 1.

With reference to FIGS. 1 and 2, a wheeled ice-melting machine is shown generally by numeral 2, and consists of framing 4 mounted on wheels 6 and adapted for rolling movement along the length of a sheet of curling ice shown generally by numeral 8. The framing 4 carries a tank 10 of propane or other compressed fuel which is fed by hose 12 to a plurality of burner nozzles which extend across the width of the machine 2, and which are shown only generally at 14 in FIG. 2.

Figure 3:
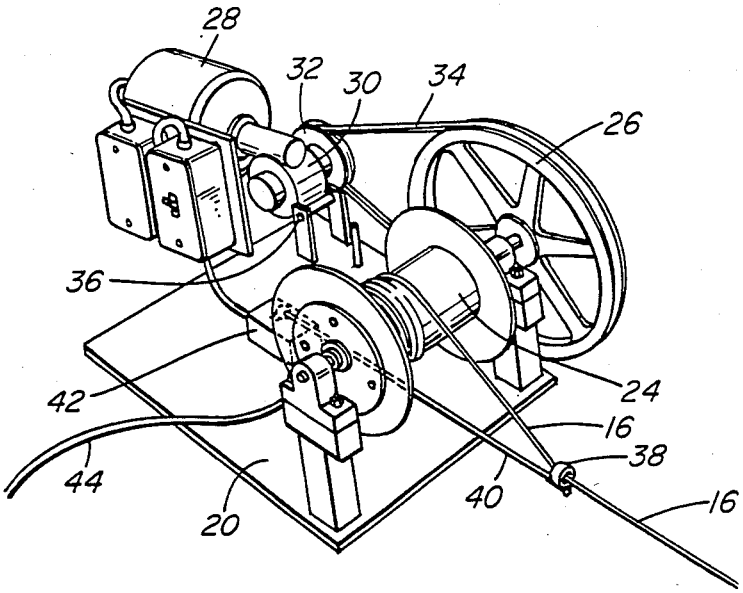
FIG. 3 illustrates in perspective view a winch arrangement in accordance with the present invention in drive belt tightening position.
Figure 4:
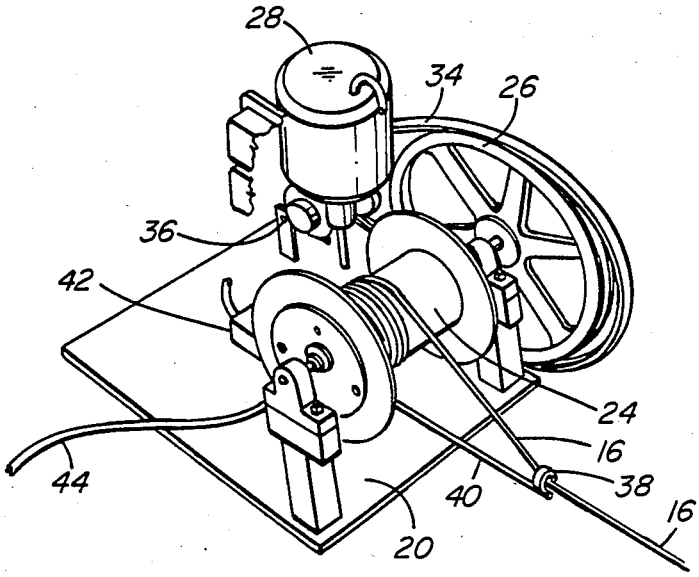
FIG. 4 illustrates in perspective view the arrangement as shown in FIG. 3, and wherein the drive belt is loosened to permit unwinding of cable from the drum.

The machine 2 is drawn along the ice sheet 8 by a cable 16 which extends from the machine to a winch arrangement shown in FIGS. 1, 3, and 4, by numeral 18. As shown in FIG. 1 the winch arrangement is provided with a base plate 20 which is adapted for removal securement (not specifically shown) to solid flooring 22 adjacent one end of the ice sheet 8. This removable securement is, of course, to enable the winch arrangement 18 to be moved from ice sheet to ice sheet as required.

One end of the cable 16 is secured to a winch drum 24 which as shown is rotatably mounted and is fast with a driven pulley 26.

The winch arrangement has an electric motor 28 which through a gear reduction mechanism 30 drives drive pulley 32 and which in turn when in operation drives driven pulley 26 by drive belt 34.

As will be seen in FIG. 3 the gear reduction device 30 and attached electric motor 28 are mounted as at 36 for pivoting movement from the drive position as shown in FIG. 3 to the rest belt-loosened position as shown in FIG. 4. In the position shown in FIG. 3, the weight of the motor 28 exerts tension on drive belt 34 to enable the motor to rotate the drum 24 to wind the cable thereon. When the motor assembly is pivoted to the position as shown in FIG. 4, the drive pulley 32 moves toward the driven pulley 26 to loosen the belt as shown and this enables the cable 16 to be unwound from the drum.

As will be clearly appreciated from FIG. 1, rotation of drum 24 will result in the winding of cable 16 thereon in a side-by-side winding relationship to pull the ice-melting machine towards the winch. As the speed of rotation of the drum is constant, and as the cable is wound thereon in side-by-side uniform single winding relationship as shown in FIGS. 3 and 4, it will be appreciated that the rotation of the drum results in the melting machine being drawn to the winch at a uniform speed and which speed may be varied by adjustment of the gear reduction means 30 and/or the drive pulley 32 which preferably is of the adjustable type.

The winch arrangement preferably includes stop means to cease rotation of the drum When the melting machine 2 has reached the end of the ice-sheet 8 adjacent the winch. Conveniently, this can be done by having the cable 16 pass through a collar or sleeve 38 which is carried by rod 40 which is connected to an off-on switch 42 placed in the wire 42 supplying electricity to the motor. In operation, the switch 42 is in forward or "on" position as shown in FIG. 1, and the cable simply passes through collar 38 on its way to the drum. When, however, the cable urges the collar 38 and rod 40 rearwardly the switch 42 is moved to the "off" position to disconnect electric power to the motor and stop rotation of the drum. As will be seen in FIG. 1, the cable is branched as at 44 into two leads 46 and 48 which join the outer sides of the machine 2 and when this branch 44 reaches collar 38 it imparts movement thereto to disconnect the power supply. Of course, other disconnect arrangements are possible and rather than having the cable branch 44 contact the collar, a clamp or other enlargement (not shown) could be secured at any position along the cable and which upon contact with the collar 38 would stop the motor.

As indicated earlier, one preferred embodiment of the invention involves the automatic shut-down of fuel to the burners 14 of the melting machine in the event of a relaxation of the tension in the cable drawing the machine such as for example would happen with any interruption of electrical power to the motor or when the winch is automatically stopped upon completion of a re-surfacing operation. A suitable arrangement is shown in FIG. 2. The hose 12 leading from the fuel tank 10 to the burners 12 is provided with a valve with handle 50 which is normally urged to closed position by spring 52. A valve cable or wire 54 extends from the branch 44 in cable 16 to the valve 50 and when the drum 24 starts to wind the cable 16, the valve wire or cable 54 moves the valve and handle 50 against the force of spring 52 to permit fuel flow to the burners. Of course, when tension in cable 16 is relaxed, the spring 52 is the overriding force and closes the fuel valve. This arrangement ensures that not only are the burners extinguished during any stoppage of movement throughout the length of the ice sheet but also automatically stops fuel flow to the burner when the motor is automatically stopped when the machine reaches the end of the rink as discussed earlier.

Although not specifically shown, the winch and/or melting machine can individually be provided with audio and/or visual signal or alarm means to alert the attendant of malfunction or to signal the completion of a re-surfacing operation. In the case of the melting machine this alarm could be in the form of a battery-powered light and/or buzzer which would become activiated as a result of relaxation of the tension in wire 54 or upon closure of the valve with handle 50. The light and/or buzzer associated with the winch could be powered by the a.c. current driving the winch and be activated by movement of rod 40.

It is important, of course, that in addition to drawing the ice-melting machine along the ice surface at a constant rate of speed that this speed be adjustable to enable the burners to melt the ice to a desired depth for proper resurfacing.

A curling rink is 146 feet long and it has been observed that it takes approximately 40 minutes for the melting machine to travel this length to provide time for a good deep melt along the length of the rink. To achieve this time/distance ratio, the diameter of the winding drum and the speed of rotation of the drum will be selected accordingly. While various ratios of drum diameter and drum rotation speed are possible, it has been found that the use of an electric motor having a rated speed of 1550 rpm with a gear reduction ratio of 60 to 1 with a 12 inch driven pulley with a 2 inch diameter drum (circumference of $6\frac{1}{2}$ inches) receiving a small diameter cable provides a necessary movement speed to the melting machine for efficient results. This arrangement provides the drum with an rpm of about 6. The cable conveniently can be of small 1 mm diameter.

While the desired travel time may be preferably approximately 40 minutes, it will be appreciated that greater or less time of travel can be obtained by suitable adjustment of the gear reduction assembly 30 and/or the drive pulley 32 which may be of the adjustable type.

In operation, the melting machine will move at a speed in the range of from about 3 to 4 feet per minutes depending upon the condition of the surface of the ice and the depth to which the ice is to be melted, and the diameter of the winch drum and its speed of rotation will be selected accordingly. Normally, however, it is preferred that the machine travel the length of a sheet of ice for curling in approximately 40 minutes and this means a speed of about 3.5 to 3.7 feet per minute.

We claim:

1. Apparatus particularly adapted to draw an ice melting machine at constant slow speed throughout the length of a sheet of ice of a curling rink comprising a frame for removable securement at one end of the curling rink, the frame carrying an electric motor and a rotatably mounted winch drum driven in rotation by the motor through adjustable speed reduction mechanisms, the winch drum carrying a cable of a length to extend the length of a curling rink and the drum having a uniform cylindrical cable winding surface of sufficient size enabling the winding of the length of cable thereon in uniform single winding relationship, the speed of rotation and the diameter of the drum being such as to selectively move the ice melting machine at a speed in the range of between about 3 to 4 feet per minute.

2. Apparatus according to claim 1 wherein the drum diameter and speed of rotation of the drum are such that the machine is moved at a speed of approximately 3.5 to 3.7 feet per minute.

3. Apparatus according to claim 1 wherein the speed of rotation and the diameter of the drum is such that a length of cable approximating the length of a curling rink is wound thereon in the range of about 35 to 45 minutes.

4. Apparatus according to claim 3 wherein the time of winding is about 40 minutes.

5. Apparatus according to claim 2 wherein the speed of rotation of the drum is approximately 6 rpm and the diameter of the drum is approximately 2 inches.

6. Apparatus according to claim 1 including stop means to stop the motor and rotation of the drum when a preselected length of cable is wound on the drum.

7. Apparatus according to claim 6 wherein the stop means includes a collar through which the cable passes during winding and which is connected to a motor stop switch, the cable branching or being provided with an enlargement at the preselected length which contacts the collar to move the stop switch to stop the motor.

8. Apparatus according to claim 1, wherein the ice melting machine is provided with shut-off means to stop flow of fuel for combustion upon lessening in tension of the cable.

9. Apparatus according to claim 8, wherein the shut-off means comprises a valve in a fuel supply pipe which is normally urged to closed position by spring loading, and a valve cable extending between the valve and the cable which opens the fuel valve against the spring loading when the cable is under tension and drawing the machine.

10. Apparatus according to claim 6, including audible or visual alarm means to indicate stoppage of the motor.

11. Apparatus according to claim 8, including audible or visual alarm means to indicate closure of the fuel valve.

12. In combination, a wheeled ice melting machine having a plurality of burners and adapted to be drawn along the length of a curling rink to re-surface the ice, and a low speed winch arrangement adapted for removable securement at one end of the rink to pull by a cable the melting machine at a uniform constant slow speed, and stop means to stop rotation of the winch arrangement when a preselected length of cable is wound on the drum thereof.

13. Apparatus according to claim 12,wherein the drum diameter and speed of rotation of the drum are such that the machine is moved at a speed of approximately 3 to 4 feet per minute.

14. Apparatus according to claim 12 wherein the speed of rotation and the diameter of the drum is such that a length of cable approximating the length of a curling rink is wound thereon in the range of about 35 to 45 minutes.

15. Apparatus according to claim 14 wherein the time of winding is about 40 minutes.

16. Apparatus according to claim 13 wherein the speed of rotation of the drum is approximately 6 rpm and the diameter of the drum is approximately 2 inches.

17. Apparatus according to claim 12 wherein the stop means includes a collar through which the cable passes during winding and which is connected to a motor stop winch, the cable branching or being provided with an enlargement at the preselected length which contacts the collar to move the stop switch to stop the motor.

18. Apparatus according to claim 12, wherein the ice melting machine is provided with shut-off means to stop flow of fuel for combustion upon lessening in tension of the cable.

19. Apparatus according to claim 18, wherein the shut-off means comprises a valve in a fuel supply pipe which is normally urged to closed position by spring loading, and a valve cable extending between the valve and the cable which opens the fuel valve against the spring loading when the cable is under tension and drawing the machine.

20. Apparatus according to claim 12, including audible or visual alarm means to indicate stoppage of the winch arrangement.

21. Apparatus according to claim 18, including audible or visual alarm means to indicate closure of the fuel valve.

* * * * *